US007384522B2

(12) United States Patent
Marszal et al.

(10) Patent No.: US 7,384,522 B2
(45) Date of Patent: Jun. 10, 2008

(54) ERGONOMIC LOADING APPARATUS FOR ELECTROPLATING PROCESSES

(75) Inventors: Dean N. Marszal, Southington, CT (US); Kevin J. Castonguay, Southington, CT (US)

(73) Assignee: United Technologies Corporation, Hartford, CT (US)

( * ) Notice: Subject to any disclaimer, the term of this patent is extended or adjusted under 35 U.S.C. 154(b) by 571 days.

(21) Appl. No.: 11/119,014

(22) Filed: Apr. 29, 2005

(65) Prior Publication Data

US 2006/0243588 A1 Nov. 2, 2006

(51) Int. Cl.
*C25B 9/02* (2006.01)

(52) U.S. Cl. ..... 204/297.1; 204/286.1; 204/287; 204/288.3; 204/288.6; 204/297.01; 204/297.06; 204/297.12

(58) Field of Classification Search ..... 204/286.1, 204/287, 288.3, 288.6, 297.01, 297.06, 297.1, 204/297.12
See application file for complete search history.

(56) References Cited

U.S. PATENT DOCUMENTS 3,963,894 A * 6/1976 Wachtell et al. ..... 219/69.15
5,522,975 A * 6/1996 Andricacos et al. ..... 204/288.1
5,702,574 A * 12/1997 Foster et al. ..... 204/224 R
5,792,267 A * 8/1998 Marszal et al. ..... 118/500
5,902,471 A * 5/1999 Jordan et al. ..... 205/122
5,951,340 A * 9/1999 Mueller et al. ..... 439/891
6,042,898 A * 3/2000 Burns et al. ..... 427/534
6,109,873 A * 8/2000 Brooks et al. ..... 416/62
6,162,335 A * 12/2000 Jordan et al. ..... 204/297.01
6,194,086 B1 * 2/2001 Nenov et al. ..... 428/621
6,247,895 B1 * 6/2001 Brooks et al. ..... 416/62
6,391,115 B1 * 5/2002 Marszal et al. ..... 118/721
6,589,668 B1 * 7/2003 Braithwaite et al. ..... 428/610

* cited by examiner

*Primary Examiner*—Bruce F Bell
(74) *Attorney, Agent, or Firm*—Bachman & LaPointe, P.C.

(57) ABSTRACT

A loading apparatus for use in electroplating processes includes a container designed to sealingly receive a plurality of airfoil blades fitted with gaskets. Each fitted airfoil blade is disposed in contact with a plurality of electrical contact assemblies having a spring-like design which ensures an adequate connection is made and complete plating of the airfoil blades occurs.

17 Claims, 4 Drawing Sheets

ERGONOMIC LOADING APPARATUS FOR ELECTROPLATING PROCESSES

FIELD OF USE

The present invention relates to a loading apparatus for electroplating processes and, more particularly, to an ergonomic loading apparatus for use in electroplating processes.

BACKGROUND OF THE INVENTION

Generally, electroplating processes involve lowering a workpiece or part into a plating bath containing a plating solution. The workpiece or part may be mounted within a loading apparatus, which is configured to be lowered or inserted into the plating bath(s). The part is typically dipped several times in the same bath or several different plating baths. Each time the part is removed from one bath; the part is dipped in a rinsing bath, or a "tack tank" as commonly referred to by one of ordinary skill in the art, to remove excess plating material, prevent oxidation of the part and prepare the part for the next plating bath.

One example of a loading apparatus of the prior art for electroplating processes, and utilized by Pratt & Whitney in East Hartford, Conn., a division of the United Technologies Corporation, is depicted in FIGS. 1-3. The loading apparatus 10 of the prior art is designed to receive a plurality of turbine airfoil blades (not shown).

Loading apparatus 10 has a substantially rectangular container 12 having an inwardly sloping front wall 14, an inwardly sloping back wall 16, a pair of sidewalls 18, 19, a base 20. A bus bar attachment composed of a pair of plastisol stainless steel bus bars 22, 24 is mounted to base 20 underneath each respective receptacle area 30, 31 and between base 20 and another plastisol coated stainless steel bus bar 26. Bus bars 22, 24 are both threadingly secured to bus bar 26 and base 20 by four bolts 28. A round dowel 29, threadingly secured to bus bar 26 by a bolt 27, is designed to connect to a shaft (not shown) of a conveyor apparatus for use in a line for the intended electroplating process. Container 12 includes a pair of receptacles 30, 31, each designed to receive a turbine airfoil blade (not shown). Once the airfoil blades are pneumatically inserted within receptacles 30, 31, a cover 32 is threadingly secured to container 12 by fourteen threaded bolts 34 and two pairs of threaded bolts 42. Each threaded bolt 34 is fitted between a first o-ring 35 and cover 32 within a plurality of first threaded apertures 40 of cover 32, and proximate to both front wall 14 and backwall 16, and sealed with a second o-ring 37. Each threaded-bolt 42 is fitted between a plate 43 and cover 32 within a plurality of second threaded apertures 45 of cover 32, proximate to both first sidewall 18 and second sidewall 19. Each receptacle 30, 31 includes four sidewalls 44, 46, 48 and 50 and a base 52 having an aperture 54. Sidewalls 44, 46 are formed in part by a center portion 33 of cover 32 and a center portion 39 of base 20.

As known to one of ordinary skill in the art, each airfoil blade contains a hollow cavity. In order to prevent plating solutions of one bath from entering the interior cavity of a blade and then contaminating another subsequent bath, the hollow cavities are typically filled with wax. As a result, an operator of the electroplating process must manually fill each airfoil blade's interior cavity. Each turbine airfoil blade is then inserted platform end first into each receptacle 30, 31 using a pneumatic ram or other similar device capable of generating 110 pounds per square inch (psi) to force each airfoil blade into each receptacle 30, 31. Each receptacle 30, 31 requires an airfoil blade in order to prevent transporting electroplating solutions from one bath to another and thus contaminate the baths.

Each airfoil blade must touch the interior base portion within each receptacle 30, 31 in order to receive electrical current from bus bars 22, 24 and 26. When the airfoil blade did not connect in part or completely with the receptacle's interior base portion, the plating would not evenly and/or completely adhere to the blade tip. The resulting unevenly plated airfoil blade would require a quality inspection to determine whether the blade would be scrapped or could be salvaged. In order to salvage an unevenly coated blade tip, the entire cover of the blade must be stripped, the surface cleaned and the airfoil blade reinstalled into loading apparatus 10. This process involves numerous steps which could prevent that particular airfoil blade from being re-plated for over a day or longer. Moreover, if another airfoil blade was not readily available for insertion into the empty receptacle, loading apparatus 10 would be taken off-line in order to prevent the potential contamination of the electroplating baths.

Once the operator has loaded the airfoil blades into receptacles 30, 31, the operator manually aligns cover 32 with the airfoil blades and secures it to container 12. Cover 32 weighs over approximately thirty pounds (30 lbs.) so the operator must be physically capable of lifting, placing and securing cover 32 onto container 12. Once cover 32 is in place, the operator manually inserts and tightens each bolt 34, 42 using a rachet, torque wrench, or other similar tool. Since an air tight seal must be achieved, it was not uncommon for the operator to apply the tool too strongly and accidentally strip a bolt.

At this time, the operator would attach loading apparatus 10 to a mechanized conveyor apparatus (not shown). Upon completion of the process, loading container 12 is detached from the conveyor apparatus and cover 32 is removed. As described earlier, one or more bolts 34, 42 were typically stripped while installing cover 32. In order to remove stripped bolts 34, 42, a maintenance person equipped with a cutting wheel, saw or similar device would cut away each stripped bolt thus requiring additional time and manpower and increasing the cost of plating the airfoil blades. Once bolts 34, 42 were removed, cover 32 was again manually removed by the operator and each blade tip was visually inspected to determine whether or not an acceptable plating was achieved.

The process for coating airfoil blade tips proved to be time consuming, inefficient and cost prohibitive. The tooling costs and additional manpower contributed both time and costs to each run of the production line. The contamination of plating baths also contributed additional time and even temporarily shut down the process to replace a bath and/or tack tank solution. If the operator discovered loading apparatus 10 was carrying excess bath or tack tank solution, then the operator was required to dismantle loading apparatus 10 in order to clean and remove the contaminants. Likewise, if the operator discovered an airfoil became contaminated, then the airfoil blade had to be removed and replaced, if possible, in order to prevent future contamination. Again, the production line would be halted to remove the airfoil blade, and either replace the blade or halt the line if a replacement blade was not available.

In addition to line problems, operators required a pneumatic ram or other device to insert each airfoil blade into receptacles 30, 31. Operators also had to be physically capable of manually lifting, aligning and placing a 30+ lbs. cover 32 onto container 12, and then securing cover 32 to container 12 using a torque wrench, rachet and the like, to tighten eighteen bolts. Inevitably, one or more bolts would be stripped and require a technician or maintenance personnel to cut or saw off the stripped bolt from loading apparatus 10 in order to remove cover 32. Moreover, and even if the production line operated smoothly, there was always a question as to whether all of the airfoil blade tips would be coated properly.

Consequently, there exists a need for an improved loading apparatus designed to receive airfoil blades without the use of a pneumatic tool and capable of maintaining the integrity of its seal to prevent contamination of the airfoils as well as baths and tack tanks.

SUMMARY OF THE INVENTION

In accordance with the present invention, a loading apparatus for use in electroplating processes broadly comprises a container comprising a front wall, a back wall, a first sidewall, a second sidewall and a base having an interior area comprising a first receptacle and a second receptacle separated by a dividing wall; an h-beam comprising a first lip and a second lip is disposed contiguous to and transverses the first sidewall and the second sidewall, and disposed upon the dividing wall; a first cover defined by a first perimeter and comprising a plurality of second apertures designed to sealingly receive an airfoil blade fitted with a gasket, and a plurality of first clamping mechanisms along the first perimeter disposed upon and aligned with the first receptacle; a second cover defined by a second perimeter and comprising a plurality of second apertures designed to sealingly receive an airfoil blade fitted with a gasket, and a plurality of second clamping mechanisms along the second perimeter disposed upon and aligned with the second receptacle; a plurality of first electrical contact assemblies disposed within a first base of the first receptacle; a plurality of second electrical contact assemblies disposed within and a second base of the second receptacle; a bus bar mounted underneath the base of the container and in contact with the plurality of electrical contact assemblies; and a round dowel comprising an attachment to an apparatus for an electroplating process secured to the bus bar opposite the base of the container.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

The loading apparatus of the present invention is designed to overcome the disadvantages of the prior art and accomplish the following objectives: (1) eliminate the need to fill the hollow cavity each airfoil blade with wax or other sealing material; (2) eliminate a press for loading airfoil blades into the apparatus; (3) eliminate the cover previously utilized in the loading apparatus of the prior art; (4) eliminating the need to cut stripped bolts; (5) eliminate the need for an additional operator/technician/maintenance personnel; (6) enable complete connection of each airfoil blade with its electrical contact; (7) enable each airfoil blade to remain dry throughout the production line; (8) enable the loading of airfoil blades for each run in half the time previously required; (9) reduce by approximately eighty percent (80%) the need to rework airfoil blades; and (10) reduce the amount of drag or transfer of contaminants from one tank to another during the production line.

Figure 4:
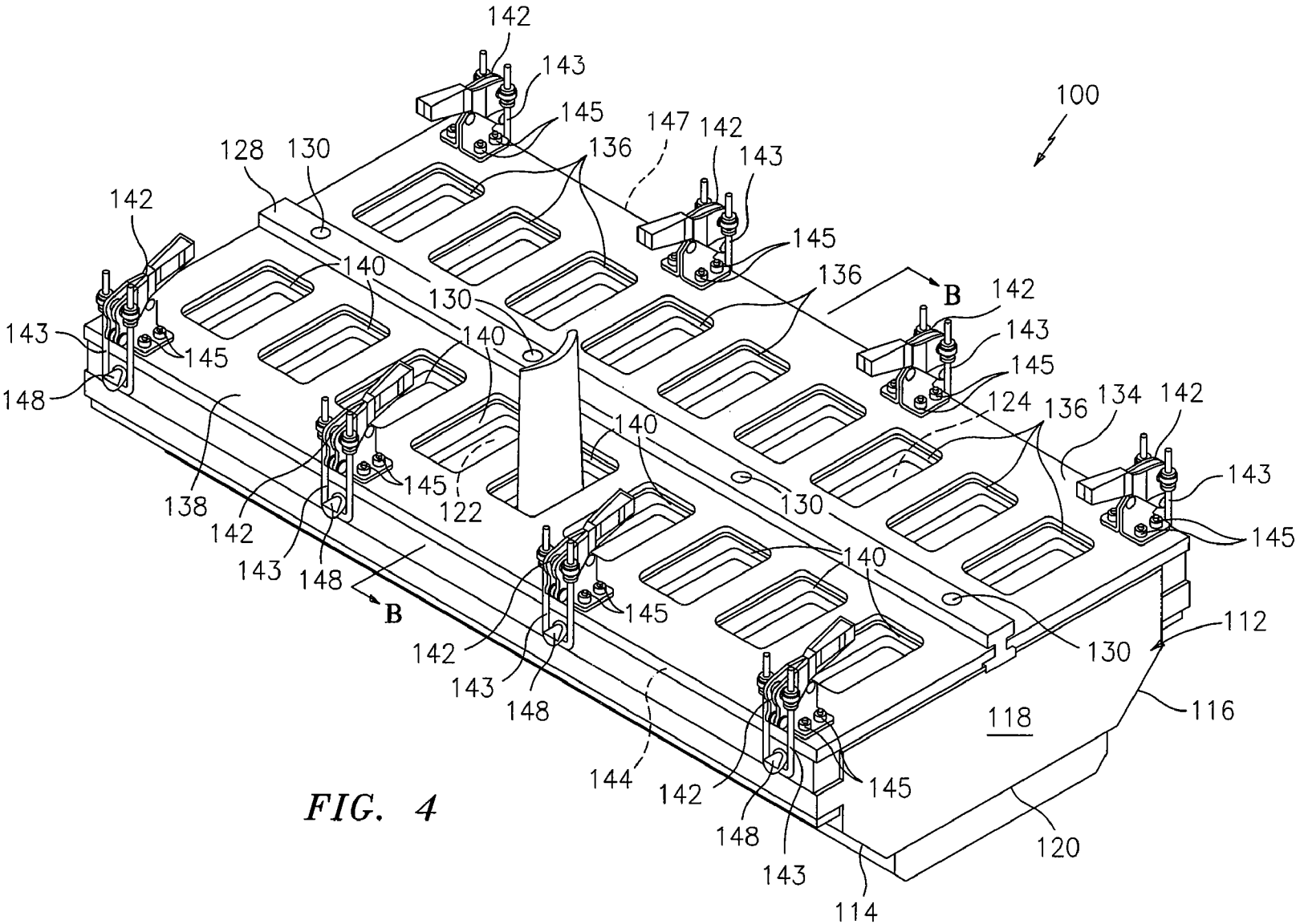
FIG. 4 is an isometric view of a loading apparatus of the present invention.
Figure 5:
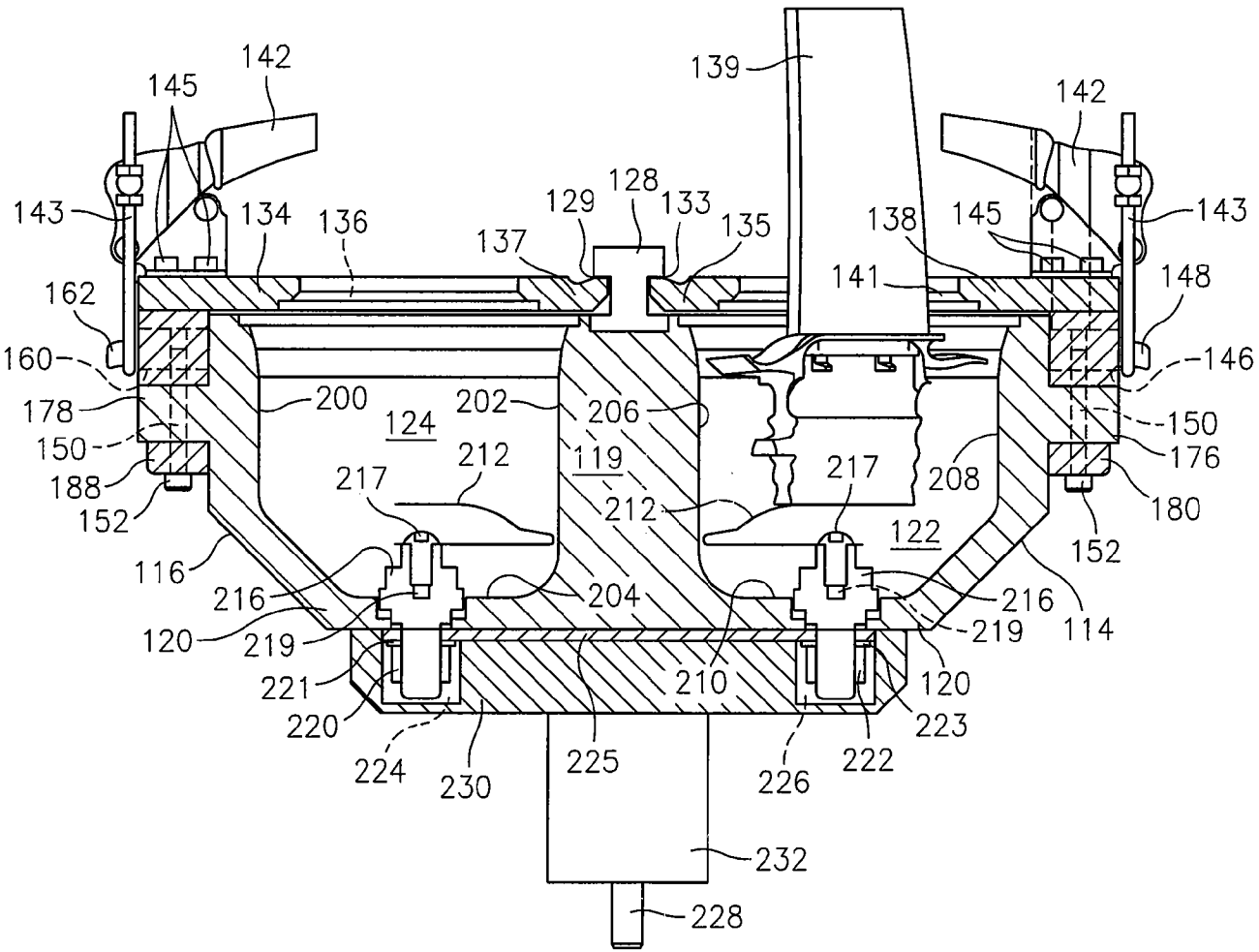
FIG. 5 is a cross-sectional view of the loading apparatus of the present invention of FIG. 4 taken along lines B-B.

Referring now to FIGS. 4 and 5, a loading apparatus 100 of the present invention broadly comprises a loading container 112 having a sloping front wall 114, a sloping back wall 116, a first sidewall 118, a second sidewall (hidden from view), an interior dividing wall 119 and a base 120 that together define interior receptacles 122, 124 designed to receive a plurality of turbine airfoil blades as shown. Interior dividing wall 119 is integral to loading container 112 and contiguous to first sidewall 118, second sidewall and base 120. An H-beam 128 is contiguous to and transverses both first sidewall 118 and second sidewall, and may include a first lip 129 and a second lip 133 designed to receive an edge 135, 137 of each cover 134, 138 to further secure each cover in place. H-beam 128 is threadingly secured on top of dividing wall 119 by four threaded bolts 130 in four matching threaded apertures (not shown).

Loading container 112 also includes a first cover 134 having a substantially rectangular shape defined by a first perimeter 144 and comprising a plurality of first apertures 136 and a second cover 138 also having a substantially rectangular shape defined by a second perimeter 147 and comprising a plurality of second apertures 140. Each cover 134, 138 is designed to sealingly receive an airfoil blade 139 fitted with a gasket 141 (See FIG. 5). For purposes of illustration and not to be taken in a limiting sense, covers 134, 138 are depicted as having nine apertures to receive nine airfoil blades 139, each fitted with a gasket 141.

Each cover 134, 138 further includes a latching means or a first and plurality of second clamping mechanisms, respectively, mounted to each cover 134, 138 along a perimeter 144 of loading container 112 and proximate to the sloping front wall 114 and sloping back wall 116. The clamping mechanism may comprise a toggle clamp 142 mounted to each cover 134, 138 using a plurality of bolts, screws, similar fasteners and the like. For purposes of illustration and not to be taken in a limiting sense, each toggle clamp 42 is fastened to its respective cover 134, 138 using four screws 145. Each clamp 142 of first cover 134 includes a latch 143 and a corresponding first latch hook 148 mounted to a first hinge piece 146 threadingly attached to a first support ledge 176 integral to loading container 112 and a first reinforcement piece 180. First hinge piece 146, first support ledge 176 and first reinforcement piece 180 all share a threaded aperture 150 which receives a threaded bolt 152 that threadingly secures all three pieces together. Likewise, each clamp 142 of second cover 138 includes a latch 143 and a corresponding second latch hook 162 mounted to a second hinge piece 160 threadingly attached to a second support ledge 178 integral to loading container 112 and a second reinforcement piece 188. Second hinge piece 160, second support ledge 178 and second reinforcement piece 188 all share a threaded aperture 150 which receives a threaded bolt 152 that threadingly secures all three pieces together.

Each receptacle 122, 124 is defined by four sidewalls and a base; however, only two pairs of sidewalls and the respective base of each receptacle 122, 124 is depicted in FIG. 5. Receptacle 122 includes a pair of sidewalls 200, 202 and a base 204, and receptacle 124 includes a pair of sidewalls 206, 208 and a base 210. Affixed within each base 204, 210 of each receptacle 122, 124 is a plurality of first electrical contact assemblies and a plurality of second electrical contact assemblies, respectively.

Each electrical contact assembly comprises an assembly body 216 having a spring-like electrical contact 212 secured by a bolt 217 disposed within an aperture 219. Assembly body 216 may be disposed within an aperture extending through base 112 and a plate 225 disposed between base 112 and a bus bar 230, and sealingly disposed within a well 224, 226 of bus bar 230. Bus bar 230 may be mounted underneath base 120 of loading container 112. An o-ring 221, 223 may be concentrically disposed about assembly body 216 and between plate 225 and a sleeve 220, 222 also concentrically disposed about assembly body 216. For purposes of illustration and not to be taken in a limiting sense, only a first electrical contact assembly disposed within said first receptacle and a second electrical contact assembly disposed within said second receptacle are shown. A round dowel 232 is threadingly secured to bus bar 230 by a bolt 228, which is designed to connect to a shaft (not shown) of a conveyor apparatus for use in a line for the intended electroplating process.

Electrical contacts 212 comprise a spring-like design such that its surface is elevated high enough to first make a connection with an airfoil blade inserted approximately seventy-five percent (75%) before being inserted completely within either receptacle 122, 124. As long as an operator can manually insert the airfoil blade and its gasket within apertures 136, 140, the airfoil blade is ensured to adequately connect with electrical contact 212.

Figure 1:
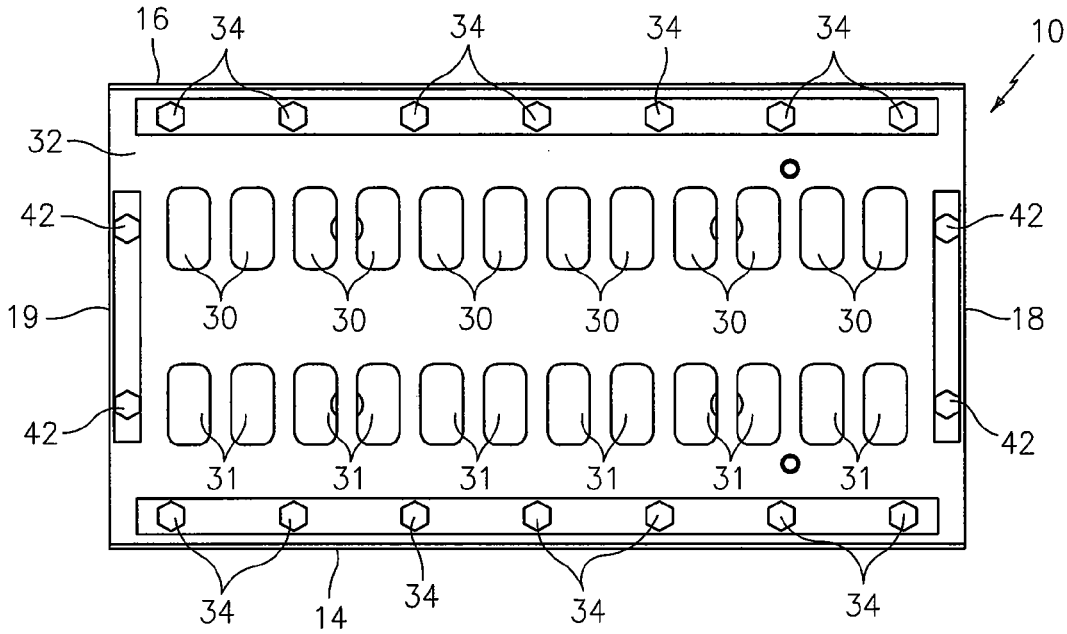
FIG. 1 (PRIOR ART)
FIG. 1 is a plan view of a loading apparatus of the prior art shown with its cover attached.
Figure 2:
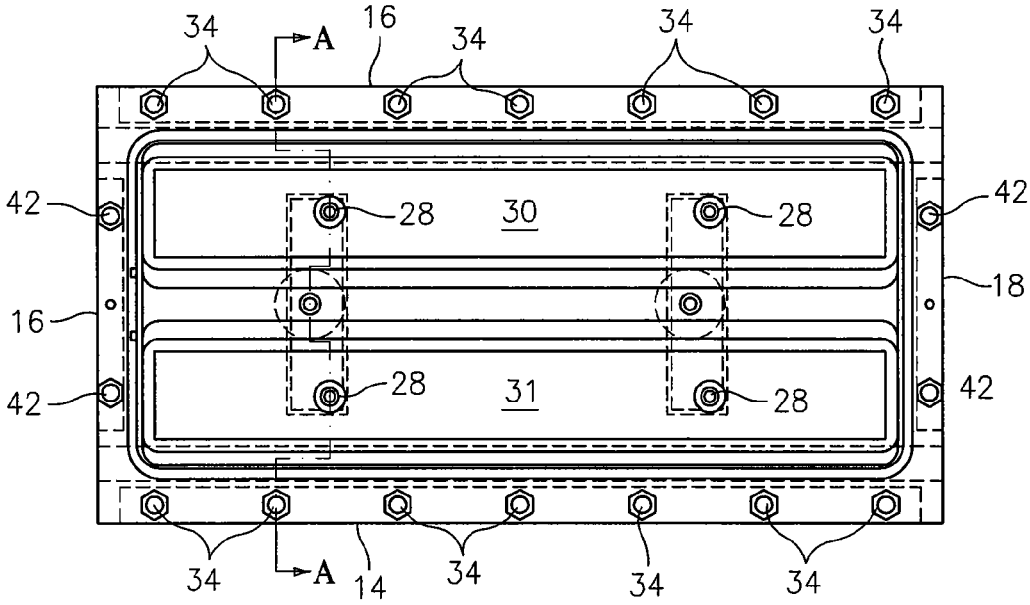
FIG. 2 (PRIOR ART)
FIG. 2 is a plan view of the loading apparatus of FIG. 1 with the cover removed.
Figure 3:
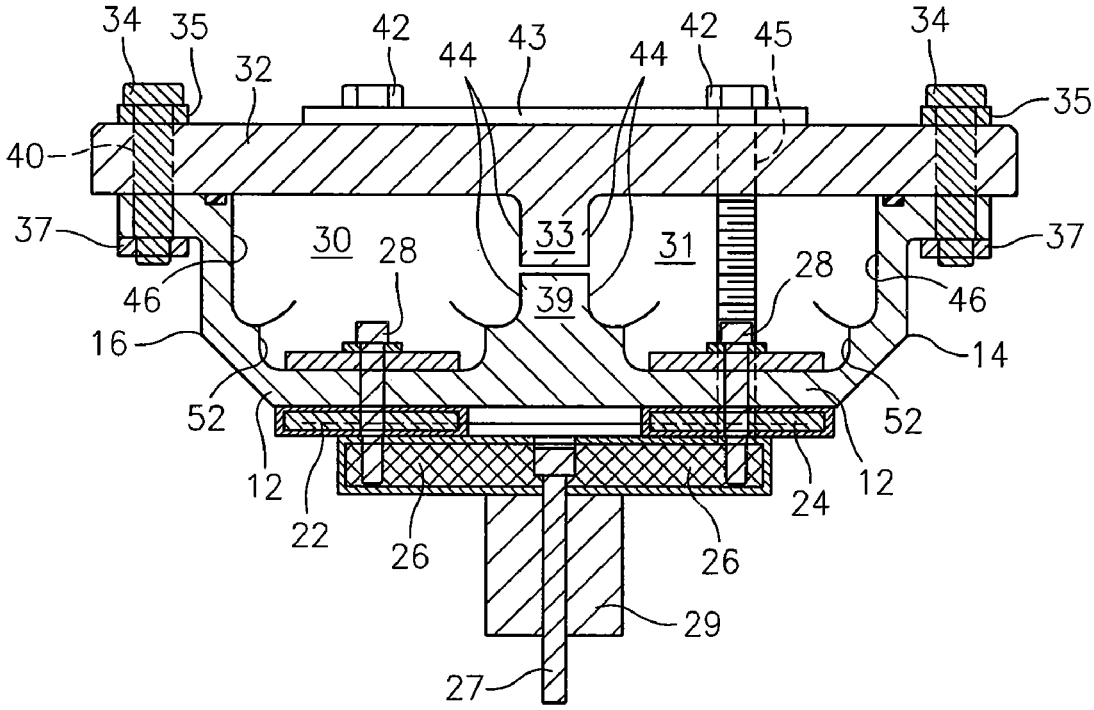
FIG. 3 (PRIOR ART)
FIG. 3 is a cross-sectional view of the loading apparatus of FIG. 2 taken along lines A-A.

Loading apparatus 100 of the present invention possesses numerous advantages over loading apparatus 10 of the prior art illustrated in FIGS. 1-3. In the prior design, loading apparatus 10 included a heavy cover 32 which some times required an operator to seek assistance in order to properly place and align onto loading container 12. From the standpoint of the operator, covers 134, 138 of loading apparatus 100 and their latch mechanism are far lighter and easier to attach to loading container 112 than cover 32 of the prior loading apparatus 10. Each cover 134, 138 is approximately half the size of cover 32 thus enabling an operator to install the cover onto the loading container without requiring assistance. In addition, a rachet, torque wrench or similar tool is no longer required to fasten the cover to the container. Toggle clamps 142 permit the operator to properly align cover 134, 138 with loading container 112 and clamp cover 134 into place. Furthermore, toggle clamps 142 equally distribute pressure across perimeter 144 of covers 134, 138 thus ensuring the cover does not distort by uneven pressure distribution and a complete seal forms. The clamping mechanism replaces the bolts previously employed and alleviates concern over removing stripped bolts. The resulting design change eliminates the need for maintenance personnel to be on hand in order to saw off stripped bolts.

Many disadvantages of the prior design involved loading airfoil blades into loading apparatus 10. For instance, in order to prevent plating solutions from one bath entering the interior cavity of a blade and then contaminating another subsequent bath, the operator filled the hollow cavities of each airfoil blade with wax. Unfortunately, if a seal did not form between cover 32 and loading container 12, plating solution and tack tank solution would still enter receptacles 30, 31 and the interior cavities of the blades too. Now, a gasket is fitted about each airfoil blade proximate to the root section prior to insertion into receptacles 122, 124. The gasket creates a seal within each aperture 136, 140 of covers 134, 138 thus ensuring both plating and tack solutions do not enter receptacles 122, 124 or the interior cavities of the airfoil blades. Moreover, the ease with which an airfoil blade may be inserted ensures the operator will not require assistance from anyone else. It is estimated that fifty percent (50%) less time is required to load a complete set of airfoil blades into loading apparatus 100 as compared to the amount of time required to load a complete set of airfoil blades into loading apparatus 10.

Another disadvantage involved the operator's reliance upon utilized a pneumatic ram or other device capable of generating enough pressure to force each airfoil blade into place. However, this technique still did not ensure the airfoil blade made an adequate connection with the interior surface of the base of its receptacle. The present design now permits the operator to simply fit a gasket about an airfoil blade and manually insert the blade into the receptacle. The operator can now visually determine whether the airfoil blade connects with electrical contact 212, 214 as the spring design ensures the airfoil blade makes contact after being inserted approximately 75% of the intended distance. As described beforehand, if the airfoil blade did not connect in part or completely with the receptacle's interior base portion, the plating solution would not evenly or completely adhere to the blade tip. The resulting unevenly plated airfoil blade would then require a quality inspection to determine whether the blade would be scrapped or salvaged. Now, the spring design of the electrical contact along with the manual insertion of each airfoil blade ensures the connection is made and maintained. As a result, the need to rework parts, that is, salvage, strip and plate the airfoil blade tip again, has been reduced approximately 80% compared to employing loading apparatus 10 of the prior art.

It is to be understood that the invention is not limited to the illustrations described and shown herein, which are deemed to be merely illustrative of the best modes of carrying out the invention, and which are susceptible to modification of form, size, arrangement of parts, and details of operation. The invention rather is intended to encompass all such modifications which are within its spirit and scope as defined by the claims.

What is claimed is:

1. A loading apparatus for use in electroplating processes, comprising:

a container comprising a front wall, a back wall, a first sidewall, a second sidewall and a base having an interior area comprising a first receptacle and a second receptacle separated by a dividing wall;

an h-beam comprising a first lip and a second lip is disposed contiguous to and transverses said first sidewall and said second sidewall, and disposed upon said dividing wall;

a first cover defined by a first perimeter and comprising a plurality of first apertures designed to sealingly receive an airfoil blade fitted with a gasket, and a plurality of first clamping mechanisms along said first perimeter disposed upon and aligned with said first receptacle;

a second cover defined by a second perimeter and comprising a plurality of second apertures designed to sealingly receive an airfoil blade fitted with a gasket, and a plurality of second clamping mechanisms along said second perimeter disposed upon and aligned with said second receptacle;

a plurality of first electrical contact assemblies disposed within a first base of said first receptacle;

a plurality of second electrical contact assemblies disposed within and a second base of said second receptacle;

a bus bar mounted underneath said base of said container and in contact with said plurality of electrical contact assemblies; and a round dowel comprising an attachment to an apparatus for an electroplating process secured to said bus bar opposite said base of said container.

2. The loading apparatus of claim 1, wherein said dividing wall is integral to said container and contiguous to said first sidewall, said base and said second sidewall.

3. The loading apparatus of claim 1, wherein said h-beam comprises a plurality of threaded apertures for receiving a plurality of threaded bolts to secure said h-beam to said dividing wall.

4. The loading apparatus of claim 1, wherein said first cover further comprises an edge designed to be received within said first lip of said h-beam.

5. The loading apparatus of claim 1, wherein said second cover further comprises an edge designed to be received within said second lip of said h-beam.

6. The loading apparatus of claim 1, wherein said first cover and said second cover further comprise a substantially rectangular shape.

7. The loading apparatus of claim 1, wherein said electrical contact assemblies each comprise an electrical contact secured by a bolt within an aperture of an assembly body.

8. The loading apparatus of claim 7, wherein said assembly body is disposed within an aperture extending through said base of said container and a plate disposed between said base and said bus bar, and sealingly disposed within a well of said bus bar.

9. The loading apparatus of claim 8, further comprising an o-ring concentrically disposed about said assembly body and between said plate and a sleeve concentrically disposed about said assembly body.

10. The loading apparatus of claim 1, wherein said front wall comprises an inwardly sloping front wall comprising a first support ledge integrally disposed therewith and a first hinge piece disposed above and in contact with said first support ledge and a first reinforcement piece disposed below and in contact with said first support ledge.

11. The loading apparatus of claim 10, wherein said first hinge piece, said first support ledge and said first reinforcement piece all comprise a plurality of threaded apertures capable of receiving a threaded bolt to threadingly secure said first hinge piece and said first reinforcement piece to said first support ledge.

12. The loading apparatus of claim 1, wherein said back wall comprises an inwardly sloping back wall comprising a second support ledge integrally disposed therewith and a second hinge piece disposed above and in contact with said second support ledge and a second reinforcement piece disposed below and in contact with said second support ledge.

13. The loading apparatus of claim 12, wherein said second hinge piece, said second support ledge and said second reinforcement piece all comprise a plurality of threaded apertures capable of receiving a threaded bolt to threadingly secure said second hinge piece and said second reinforcement piece to said second support ledge.

14. The loading apparatus of claim 1, wherein said plurality of first clamping mechanisms of said first cover are aligned with a plurality of first latch hooks mounted to a first hinge piece of said front wall.

15. The loading apparatus of claim 1, wherein said plurality of second clamping mechanisms of said second cover are aligned with a plurality of second latch hooks mounted to a second hinge piece of said back wall.

16. The loading apparatus of claim 1, wherein said plurality of first clamping mechanisms each comprise a toggle clamp fastened to said first cover and a latch connected therewith that is capable of being received by a first latch hook.

17. The loading apparatus of claim 1, wherein said plurality of second clamping mechanisms each comprise a toggle clamp fastened to said second cover and a latch connected therewith that is capable of being received by a second latch hook.

* * * * *